US011083266B2

(12) United States Patent
Cheers et al.

(10) Patent No.: US 11,083,266 B2
(45) Date of Patent: Aug. 10, 2021

(54) PURSE-SUPPORT SYSTEM

(71) Applicants: Chelcee D'Lynn Cheers, Creston, IA (US); Teresa Cheers, Creston, IA (US)

(72) Inventors: Chelcee D'Lynn Cheers, Creston, IA (US); Teresa Cheers, Creston, IA (US)

( * ) Notice: Subject to any disclaimer, the term of this patent is extended or adjusted under 35 U.S.C. 154(b) by 464 days.

(21) Appl. No.: 16/162,102

(22) Filed: Oct. 16, 2018

(65) Prior Publication Data

US 2019/0110568 A1 Apr. 18, 2019

Related U.S. Application Data

(60) Provisional application No. 62/573,581, filed on Oct. 17, 2017.

(51) Int. Cl.

| | |
|---|---|
| ***A45C 13/36*** | (2006.01) |
| ***A45C 3/06*** | (2006.01) |
| ***A45C 1/02*** | (2006.01) |
| ***A45C 13/00*** | (2006.01) |
| ***A45C 13/08*** | (2006.01) |

(52) U.S. Cl.

CPC ..... *A45C 13/36* (2013.01); *A45C 1/02* (2013.01); *A45C 3/06* (2013.01); *A45C 13/001* (2013.01); *A45C 13/002* (2013.01); *A45C 13/08* (2013.01)

(58) Field of Classification Search

CPC ..... A45C 13/36; A45C 1/02; A45C 13/002; A45C 13/08; A45C 13/001; A45C 3/06

USPC ..... 150/104, 103; 190/18 R; 16/30; 24/303; 63/900

See application file for complete search history.

(56) References Cited

U.S. PATENT DOCUMENTS

| | | | | |
|---|---|---|---|---|
| 2,803,953 | A * | 8/1957 | Zubalik | A44C 7/00 63/14.1 |
| 2,975,497 | A * | 3/1961 | Budreck | A44B 15/002 24/303 |
| 3,034,320 | A * | 5/1962 | Feibelman | A44C 7/00 63/14.1 |
| 3,041,697 | A * | 7/1962 | Budreck | A44B 15/002 24/303 |
| 6,101,688 | A * | 8/2000 | Marchesi | A41F 1/002 24/303 |
| 6,477,749 | B1 * | 11/2002 | Reiter | A41F 1/002 24/303 |
| 8,464,377 | B1 * | 6/2013 | Carson | A47G 9/02 5/498 |
| 10,588,390 | B1 * | 3/2020 | Pichardo | A45C 15/06 |
| 2015/0216266 | A1 * | 8/2015 | Franklin | A41F 1/02 24/306 |

* cited by examiner

*Primary Examiner* — James N Smalley
*Assistant Examiner* — Jennifer Castriotta

(57) ABSTRACT

A purse support system has an interior cap and an exterior foot. The interior cap and the exterior foot are identically constructed and magnetically coupled supports that can be used to non-invasively add purse feet to a purse. The exterior foot and the interior cap each have a housing, an endcap, a receptacle, and an attachment mechanism. the endcap is a smooth component that prevents the purse support system from damaging external devices. The endcap is connected to one side of the housing. The receptacle is positioned within the housing and enables the attachment mechanism to be mounted to the housing. The attachment mechanism is a magnet that couples the interior cap to the exterior foot without damaging the purse.

7 Claims, 6 Drawing Sheets

PURSE-SUPPORT SYSTEM

The current application claims a priority to the U.S. Provisional Patent application Ser. No. 62/573,581 filed on Oct. 17, 2017.

FIELD OF THE INVENTION

The present invention relates generally to a purse accessory. More specifically, the present invention relates to a system for retrofitting purses by noninvasively attaching purse feet.

BACKGROUND OF THE INVENTION

The fashion industry is a multibillion-dollar industry that is able to influence lifestyle trends across the globe. People continuously create clothing for various occasions, ranging from comfortable apparel to more formal garments. To further enhance the appearance and practicality the user may choose to add accessories such as jewelry and handbags. Some garments lack dedicated storage space for personal items. As an example, clothing that is designed for women lacks the pockets or dedicated storage compartments, therefore other personal storage accessories must be used. The terms "handbag" and "purse" are used interchangeably in modern times and they usually define an object used for on the go storage. As handbags evolved and became more complex in design, the practical usability with more efficient space management was also further developed.

The modern purse as define it today was gained popularity during the industrial revolution in England. As the railroad system developed and people began traveling more frequently, the demand for personal luggage also increased. Handbags have become luxury items, and in some cases, can even appreciate in value with time especially for rare and desirable models that have been kept in good condition. Protecting the garment for an extended period of time while still using it, can be a challenging task. To prevent any potential damage, some handbags have integrated purse feet, however most do not, for various reasons. Design and esthetics come into play significantly especially on more high-end luxury models, and many designers choose not to integrated support studs on the bottom of the purse. While aftermarket purse feet may be purchased, and attached by the user, these devices usually are secured by drilling a hole into the purse. These types of purse feet are permanent and require the user to remove the liner of the bag before installation, voiding the warranty and possibly damaging the bag.

The present invention aims to solve some of these problems by disclosing a temporary purse feet system. The user is able to simply remove the purse feet when desired and install them on another one of their bags without altering the handbag in any way. No specialized tools are required for installation and the device is interchangeable. The arrangement may be customized and fitted specifically to each handbag. Due to the various designs and shapes different configurations may be required to ensure a uniform support. Traditionally, purse feet come in complete sets of four, with each one positioned at a corner. A common problem with this particular arrangement is the lack of support for the central bottom area. If the handbag is constructed out of softer materials that are prone to sagging when heavier objects are placed inside it is not uncommon for material to stretch beyond repair. The present invention aims to fix this issue by allowing the user to insert additional support points into the bottom surface, thus allowing the weight to be evenly distributed.

DETAIL DESCRIPTIONS OF THE INVENTION

All illustrations of the drawings are for the purpose of describing selected versions of the present invention and are not intended to limit the scope of the present invention.

Referring to FIG. 1 through FIG. 6, the present invention, the purse-support system, is a system that enables a user to noninvasively attach purse feet to a purse. To achieve this functionality, the present invention employs a two-component fastener system that is designed to attach purse feet to the purse without piercing the bottom of the purse. Specifically, the present invention comprises at least one exterior foot 1 and at least one interior cap 2. Preferably, the exterior foot 1 and the interior cap 2 are identically constructed components and work in concert to form a clamp that is used to attach the present invention to the purse. To deploy the present invention, the user first places the interior cap 2 against an interior surface of the purse. The user then places the exterior foot 1 against an exterior surface of the purse. The user then couples the exterior foot 1 to the interior cap 2. Thus, clamping the purse between the interior cap 2 and the exterior foot 1.

Figure 1:
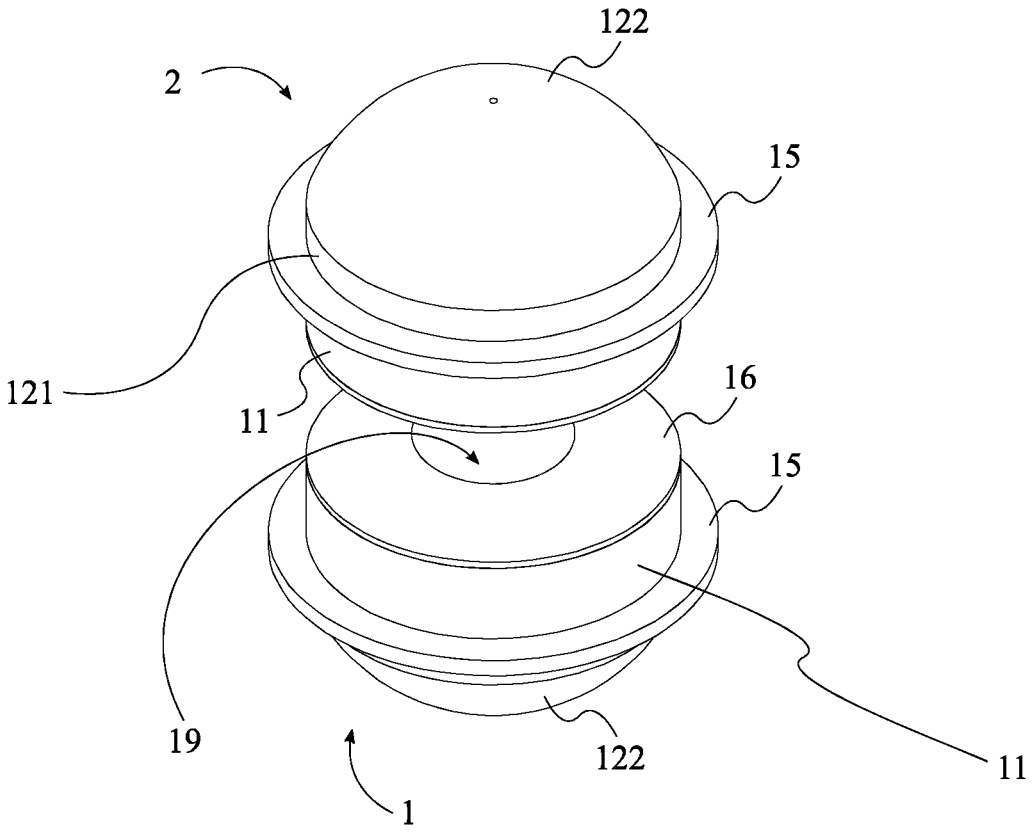
FIG. 1 is a perspective view of the present invention.
Figure 2:
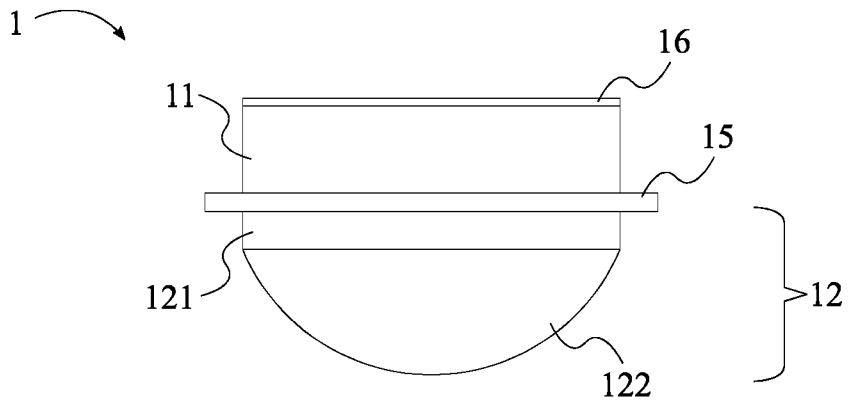
FIG. 2 is a front view of the exterior foot used in the present invention.
Figure 5:
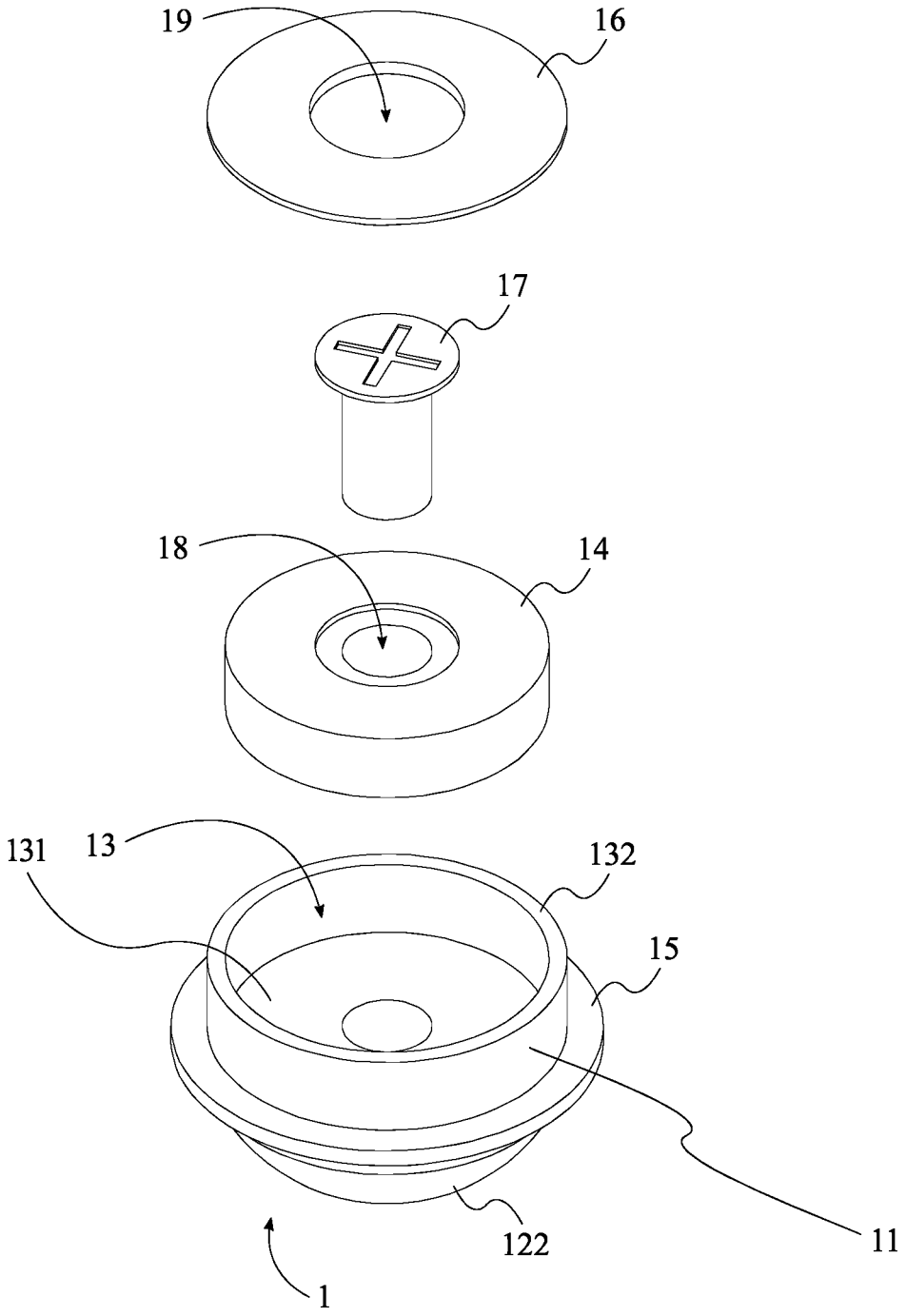
FIG. 5 is an exploded top perspective of the exterior foot used in a first alternative embodiment of present invention.

Referring to FIG. 1 and FIG. 5, to achieve the above-described functionality the exterior foot 1 and the interior cap 2 each comprise a housing 11, an endcap 12, a mechanism receptacle 13, and an attachment mechanism 14. The housing 11 forms the structural foundation of the present invention and acts as the central component onto which the remaining parts of the present invention are mounted. The endcap 12 is connected adjacent to the housing 11. Thus positioned, the endcap 12 acts as a support pad that comes into contact with a surface on which the purse rests. Preferably, the endcap 12 has a smoothed exterior surface that prevents the present invention from scratching exterior surfaces. This prevents the endcap 12 from scratching personal items stored within the purse or the surface on which the purse rests.

Referring to FIG. 1 and FIG. 5, the present invention is designed to function as a retrofit system that enables a user to noninvasively attach purses feet to purses. To accomplish this, the attachment mechanism 14 is a connector system that enables the interior cap 2 and the exterior foot 1 to be attached to the purse without piercing the purse. The mechanism receptacle 13 traverses into the housing 11, opposite to the endcap 12. Additionally, the attachment mechanism 14 is mounted within the mechanism receptacle 13. Accordingly, the attachment mechanism 14 is affixed to the housing 11 and retained in a position that facilitates attaching the exterior foot 1 and the interior cap 2 to the purse. Specifically, the attachment mechanism 14 of the exterior foot 1 is detachably coupled to the attachment mechanism 14 of the interior cap 2. To accomplish this, the attachment mechanism 14 of the exterior foot 1 and the attachment mechanism 14 of the interior cap 2 are oppositely polarized magnets. Consequently, the attachment mechanism 14 of the interior cap 2 generates an attractive force on the exterior foot 1. Thus, clamping the base of the purse in between the interior cap 2 and the exterior foot 1.

Figure 6:
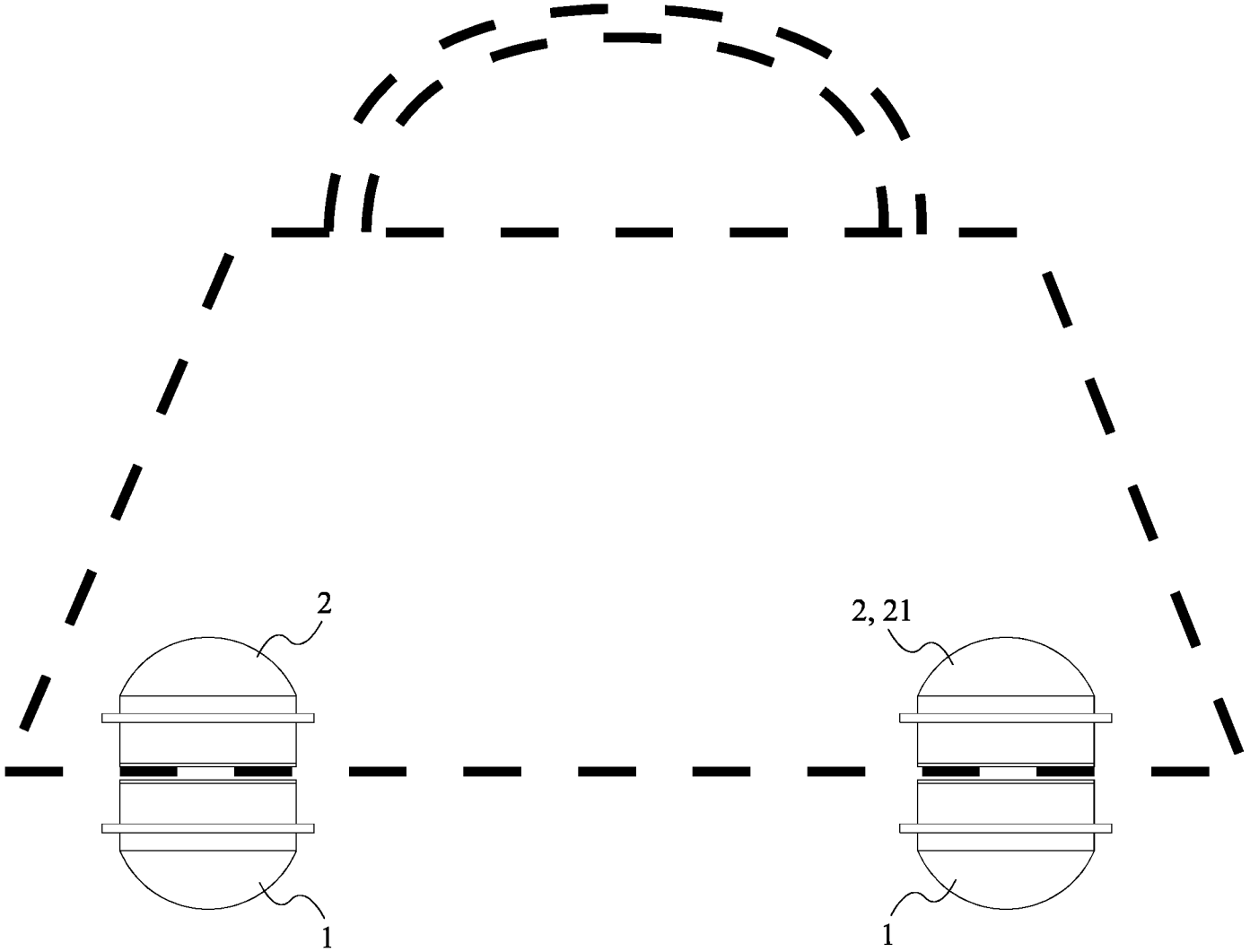
FIG. 6 is a left side view showing the present invention being attached to a purse.

Referring to FIG. 5 and FIG. 6, the present invention is designed to use the two-component fastener system as the basis for noninvasively attaching multiple purse feet to the purse. To achieve this, the at least one exterior foot 1 is a plurality of exterior feet and the at least one interior cap 2 is a plurality of interior caps 2. Additionally, the attachment mechanism 14 of each of the plurality of exterior feet is detachably coupled to the attachment mechanism 14 of a corresponding cap 21 from the plurality of interior caps 2. Accordingly, the user is able to distribute the plurality of exterior feet and the plurality of interior caps 2 across the purse in a pattern that prevents the base of the purse from being placed against the surface on which the purse rests. This distributed array of the plurality of exterior feet enables the user to create a custom support system for purses of varying shape and size.

Figure 3:
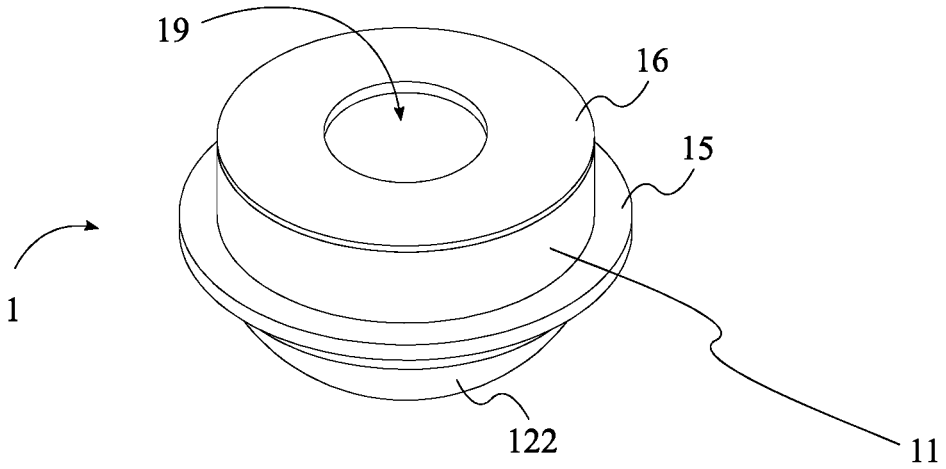
FIG. 3 is a top perspective of the exterior foot used in the present invention.
Figure 4:
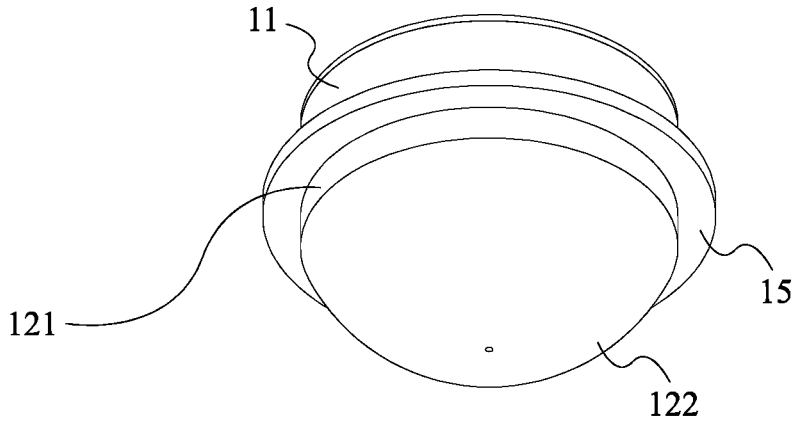
FIG. 4 is a bottom perspective of the exterior foot used in the present invention.

Referring to FIG. 3 and FIG. 5, as described above, the endcap 12 is designed to have a scratch-reducing exterior surface. To that end the endcap 12 comprises a connector platform 121 and a dome 122. The connector platform 121 is adjacently connected to the dome 122. Additionally, the connector platform 121 is connected in between the dome 122 and the housing 11. As a result, the connector platform 121 retains the dome 122 in a position that facilitates supporting the purse. Further, the connector platform 121 retains the dome 122 in an orientation that prevents the exterior foot 1 from scratching external surfaces. Preferably the dome 122 has a semicircular profile. The present invention is designed to support the weight of the purse without damaging the surface of the purse itself. To facilitate this, the present invention comprises a flange 15. The flange 15 is laterally connected around the housing 11. Additionally, the flange 15 is positioned adjacent to the endcap 12. As a result, the flange 15 enables the exterior foot 1 to support a larger area of the purse. Thus, distributing the weight of the purse and keeping the purse offset from the surface on which the purse rests.

Referring to FIG. 3 and FIG. 5, preferably the attachment mechanism 14 is encapsulated within the mechanism receptacle 13. To facilitate this the present invention comprises a cover 16. The cover 16 is mounted over an opening 132 of the mechanism receptacle 13. Additionally, the attachment mechanism 14 is positioned in between a base 131 of the mechanism receptacle 13 and the cover 16. Consequently, the cover 16 prevents the attachment mechanism 14 from coming into physical contact with the external environment. Preferably the cover 16 is composed of a magnetically permeable material that does not impede magnetically coupling the exterior foot 1 to the interior cap 2. Additionally, the cover 16 and the housing 11 are fused to form a unibody component. The present invention further comprises a flux-transfer hole 19. The flux-transfer hole 19 traverses into the mechanism receptacle 13 through the cover 16. Accordingly, the attachment mechanism 14 of the interior cap 2 can be magnetically coupled to the attachment mechanism 14 of the exterior foot 1.

Referring to FIG. 3 and FIG. 5, in a first alternative embodiment of the present invention, the cover 16 is detachable, and the attachment mechanism 14 can be removed or replaced. To achieve this functionality, the present invention further comprises at least one screw 17 and at least one mounting hole 18. The mounting hole 18 normally traverses though the attachment mechanism 14 and into the base 131 of the mechanism receptacle 13. Additionally, the screw 17 engages into the mounting hole 18. As a result, the screw 17 retains the attachment mechanism 14 within the mechanism receptacle 13 while the cover 16 is removed. As described above, the present invention is a system that is designed to support the weight of the purse without damaging the purse. To that end, a ratio of a diameter of the mechanism receptacle 13 to a depth of the mechanism receptacle 13 is 0.750 inches to 0.188 inches. Accordingly, the present invention is able to provide the necessary magnetic attraction force.

Although the invention has been explained in relation to its preferred embodiment, it is to be understood that many other possible modifications and variations can be made without departing from the spirit and scope of the invention as hereinafter claimed.

What is claimed is:

1. A purse-support system comprising:

at least one exterior foot and at least one interior cap;

the exterior foot and the interior cap each comprising a housing, an endcap, a mechanism receptacle, and an attachment mechanism;

the endcap of the exterior foot being adjacently connected to the housing of the exterior foot;

the mechanism receptacle of the exterior foot traversing into the housing of the exterior foot, opposite to the endcap of the exterior foot;

the attachment mechanism of the exterior foot being mounted within the mechanism receptacle of the exterior foot;

the endcap of the interior cap being adjacently connected to the housing of the interior cap;

the mechanism receptacle of the interior cap traversing into the housing of the interior cap, opposite to the endcap of the interior cap;

the attachment mechanism of the interior cap being mounted within the mechanism receptacle of the interior cap;

the attachment mechanism of the exterior foot being detachably coupled to the attachment mechanism of the interior cap;

the exterior foot and the interior cap each further comprising a cover;

the cover of the exterior foot being mounted over an opening of the mechanism receptacle of the exterior foot;

the attachment mechanism of the exterior foot being positioned in between a base of the mechanism receptacle of the exterior foot and the cover of the exterior foot;

the cover of the interior cap being mounted over an opening of the mechanism receptacle of the interior cap;

the attachment mechanism of the interior cap being positioned in between a base of the mechanism receptacle of the interior cap and the cover of the interior cap;

the exterior foot and the interior cap each further comprising a flux-transfer hole;

the flux-transfer hole of the exterior foot traversing into the mechanism receptacle of the exterior foot through the cover of the exterior foot; and the flux-transfer hole of the interior cap traversing into the mechanism receptacle of the interior cap through the cover of the interior cap.

2. The purse-support system as claimed in claim 1 comprising:

the at least one exterior foot being a plurality of exterior feet;

the at least one interior cap being a plurality of interior caps; and the attachment mechanism of each of the plurality of exterior feet being detachably coupled to the attachment mechanism of a corresponding cap from the plurality of interior caps.

3. The purse-support system as claimed in claim 1 comprising:

the endcap of the exterior foot comprising a connector platform and a dome;

the connector platform of the exterior foot being adjacently connected to the dome of the exterior foot;

the connector platform of the exterior foot being connected in between the dome of the exterior foot and the housing of the exterior foot;

the endcap of the interior cap comprising a connector platform and a dome;

the connector platform of the interior cap being adjacently connected to the dome of the interior cap; and the connector platform of the interior cap being connected in between the dome of the interior cap and the housing of the interior cap.

4. The purse-support system as claimed in claim 1 comprising:

the exterior foot and the interior cap each further comprising a flange;

the flange of the exterior foot being laterally connected around the housing of the exterior foot;

the flange of the exterior foot being positioned adjacent to the endcap of the exterior foot;

the flange of the interior cap being laterally connected around the housing of the interior cap; and the flange of the interior cap being positioned adjacent to the endcap of the interior cap.

5. The purse-support system as claimed in claim 1 comprising:

the exterior foot and the interior cap each further comprising at least one screw and at least one mounting hole;

the mounting hole of the exterior foot normally traversing though the attachment mechanism of the exterior foot;

the mounting hole of the exterior foot traversing into a base of the mechanism receptacle of the exterior foot;

the screw of the exterior foot engaging into the mounting hole of the exterior foot;

the mounting hole of the interior cap normally traversing though the attachment mechanism of the interior cap;

the mounting hole of the interior cap traversing into a base of the mechanism receptacle of the interior cap; and the screw of the interior cap engaging into the mounting hole of the interior cap.

6. The purse-support system as claimed in claim 1, wherein a ratio of a diameter of the mechanism receptacle of the exterior foot to a depth of the mechanism receptacle of the exterior foot being 0.750 inches to 0.188 inches, wherein a ratio of a diameter of the mechanism receptacle of the interior cap to a depth of the mechanism receptacle of the interior cap being 0.750 inches to 0.188 inches.

7. The purse-support system as claimed in claim 1 wherein the attachment mechanism of the exterior foot and the attachment mechanism of the interior cap being oppositely polarized magnets.

* * * * *